United States Patent [19]

Hayashi

[11] Patent Number: 4,937,409

[45] Date of Patent: Jun. 26, 1990

[54] SWITCH DEVICE

[75] Inventor: Fujio Hayashi, Aichi, Japan

[73] Assignee: Kabushiki Kaisha Tokai Rika Denki Seisakusho, Aichi, Japan

[21] Appl. No.: 298,153

[22] Filed: Jan. 17, 1989

[30] Foreign Application Priority Data

Jan. 19, 1988 [JP] Japan ..... 63-5269[U]

[51] Int. Cl.[5] ..... H01H 3/42

[52] U.S. Cl. ..... 200/524; 200/520

[58] Field of Search ..... 200/524, 533, 520, 573, 200/574, 250, 255

[56] References Cited

U.S. PATENT DOCUMENTS

| | | | |
|---|---|---|---|
| 4,531,026 | 7/1985 | Terajima et al. | 200/524 |
| 4,543,459 | 9/1985 | Hayashida | 200/524 |
| 4,585,914 | 4/1986 | Ohashi et al. | 200/524 |
| 4,670,629 | 6/1987 | VanBenthuysen et al. | 200/524 |
| 4,785,146 | 11/1988 | Dünki et al. | 200/250 |

*Primary Examiner*—Henry J. Recla
*Assistant Examiner*—Glenn T. Barrett
*Attorney, Agent, or Firm*—Finnegan, Henderson, Farabow, Garrett, and Dunner

[57] ABSTRACT

A switch device including a casing, a depressible operating member at least partially mounted within the casing and being movable between a protruding position and a depressed position, a cam member movable between an inoperative and operative position in response to the depression of the operating member, the cam member including a cam groove having a loop-like shape, a return spring for urging the cam member toward the inoperative position, an elongated engaging member having one end mounted on the casing and the other end movably disposed in the cam groove, the other end being lockingly engageable in the cam groove to hold the cam member in both inoperative and operative positions, a cushioning member mounted within the casing, the cushioning member being made of a material having elasticity and a high coefficient of friction, and disposed to abuttingly engage the operating member when the operating member is returned from the depressed position to the protruding position, the cushioning member having a holder portion for frictionally engaging the engaging member to urge the other end of the engaging member into the cam groove, and a switch mounted within the casing for being opened and closed in response to the movement of the cam member.

9 Claims, 3 Drawing Sheets

SWITCH DEVICE

BACKGROUND OF THE INVENTION

1. Field of The Invention

This invention relates to a push-button switch that is alternately opened and closed each time an associated push-button is depressed.

2. Description of The Related Art

A conventional push-button switch comprises a depressible operating member disposed in a switch casing, a cam member secured to a lower end of the operating member for movement therewith, a return spring acting between the cam member and the bottom of the casing for urging the cam member toward its initial or inoperative position, and a switch means received within the casing for being opened and closed in accordance with the movement of the cam member. The conventional switch device further comprises a lock means for holding the cam member in its operative position upon depression of the operating member and for releasing the switch from its locked position when the operating member is depressed again.

FIG. 6 shows such a conventional locking means. Specifically, the cam member 40 has a generally heart-shaped cam groove 41. The cam groove 41 has a deep lower retaining portion 42, a right-hand side portion 43 that extends upward from the lower retaining portion 42 to a deep upper portion 45 and progressively decreases in depth towards its upper end. A step 44 is provided between right-hand side portion 43 and deep upper portion 45. The cam groove 41 also includes a left-hand side portion 48 that extends downward from the upper portion 45 to the lower retaining portion 42 and progressively decreases in depth towards its lower end. The upper portion 45 includes an upper retaining portion 46 at its central portion. The bottom surface of the cam groove 41 also includes a step 47 in the region connecting the left-hand side portion 48 and the lower retaining portion 42. Thus, the cam groove 41 forms a closed loop. An engaging member or lock pin 49 made of a metal wire has an upper end mounted on the switch casing while a lower end **49*a* is disposed to move along the cam groove 41. A leaf spring 50 is mounted within the switch casing and acts on the lock pin 49 to urge its lower end 49*a* into the cam groove 41**.

In the inoperative position of the cam member 40, the lower end **49*a* of the lock pin 49 is retained in the lower retaining portion 42 of the cam groove 41. When the operating member is depressed, it causes the cam member 40 to move downward, so that the lower end 49*a* of the lock pin 49 slides along the right-hand side portion 43 of the cam groove 41 to the upper portion 45 via the step 44. Then, when the operating member is released, the cam member 40 moves slightly upward under the influence of the return spring, so that the lower end 49*a* of the lock pin 49 moves to the left towards the upper retaining portion 46 of the upper portion 45. This holds the cam member 40 in its operative position. When the operating member is depressed again, the cam member 40 moves downward so that the lower end 49*a* of the lock pin moves to the left along the upper portion 45 of the cam groove 41. When the operating member is released, the influence of the return spring causes the lower end 49*a* of lock pin 49 to move toward the left-hand side portion 48 of the cam groove 41 and then to move along the left-hand portion 48. In this way the lower end 49*a* is received in the lower retaining portion 42 via the step 47, and the cam member 40** is returned to its initial position.

Thus, when the cam member 40 is moved between its inoperative and operative positions, the lower end **49*a* of the lock pin 49 is moved along the cam groove 41. Since the cam groove includes the steps 44 and 47 and also has a loop-like shape, the lock pin 49 is moved back and forth in a direction perpendicular to the surface of the cam member 40. When the lock pin 49 is moved back and forth, the lock pin 49 discontinuously strikes the leaf spring 50 and produces an undesirable sound. In addition, when the lock pin 49 is abruptly moved back and forth, there is a risk that the lower end 49*a* of the lock pin 49 may be disengaged from the cam groove 41**.

SUMMARY OF THE INVENTION

An object of the present invention is a switch device capable of silent operation.

Another object of the present invention is an improved switch of the push button type.

A further object of the invention is a less expensive switch device that does not require the use of a leaf spring.

These and other objects are accomplished by a switch device comprising a casing having an elongated axis, a cam member disposed within the casing and including a groove, an engaging member mounted within the casing and having an end portion movable along the groove, a depressible operating member having a portion movably mounted within the casing to move in a direction parallel to the elongated axis of the casing for causing relative movement between the cam member and the engaging member, and a cushioning member mounted within the casing and constructed of a material having elasticity and a high coefficient of friction, the cushioning member including a holder portion for frictionally engaging the engaging member.

BRIEF DESCRIPTION OF THE DRAWINGS

The manner in which the above objects and other objects, features, and advantages of the present invention are attained will be fully apparent from the following detailed description when considered in view of the drawings, wherein:

FIG. 5(*b*) is a perspective view of a portion of the cam member of FIG. 2.

DESCRIPTION OF THE PREFERRED EMBODIMENT OF THE INVENTION

The present invention comprises a switch device including a casing, a depressible operating member at least partially mounted within the casing and being movable between a protruding position and a depressed position. The operating member is attached to a cam member that is movable between an inoperative and operative position in response to the depression of the operating member. The cam member includes a cam groove having a loop-like shape. A return spring is provided beneath the cam member for urging the cam member toward the inoperative position.

An elongated engaging member is disposed within the casing and has one end mounted on the casing and the other end movable disposed in the cam groove. The end disposed in the cam groove can be locked to hold the cam member in both inoperative and operative positions.

A cushioning member is mounted within the casing, and is made of a material having elasticity and a high coefficient of friction. The cushion member is disposed to abuttingly engage the operating member when the operating member is returned from a depressed position to a protruding position. The cushioning member also includes a holder portion for frictionally engaging the engaging member to urge one end of the engaging member into the cam groove. Finally, the invention includes a switch mounted within the casing for being opened and closed in response to the movement of the cam member.

A cushioning member having no holder portion is conventionally employed. The use of the holder portion on the cushioning member obviates the need for a leaf spring, such as the leaf spring 50 used in the above-mentioned prior art. Therefore, the number of component parts is reduced, and the time and labor required for mounting such a leaf spring is saved. The switch device according to the present invention can therefore be manufactured at lower costs.

Figure 1:
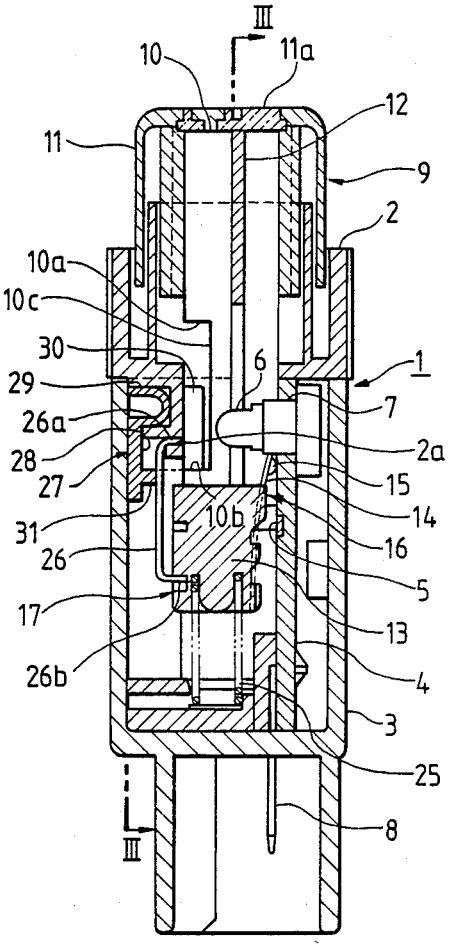
FIG. 1 is a cross-sectional view of a switch device in accordance with the present invention showing the operating member in its protruding position.
Figure 2:
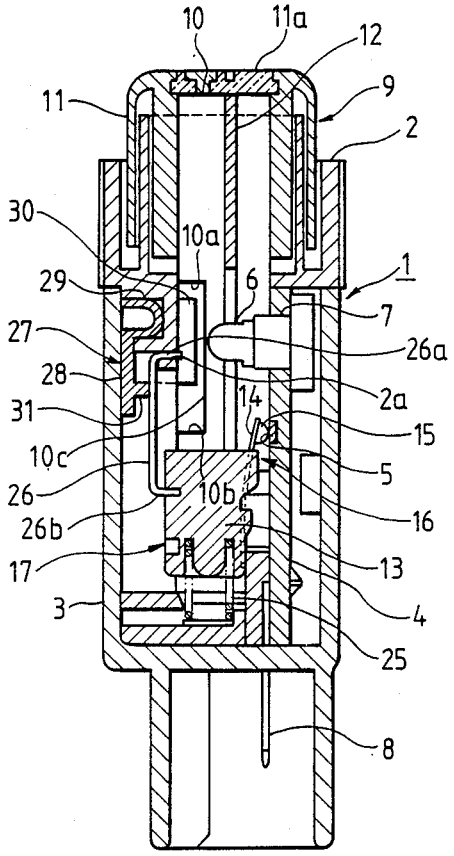
FIG. 2 is a cross-sectional view of the switch of FIG. 1 showing the operating member in its depressed position.
Figure 3:
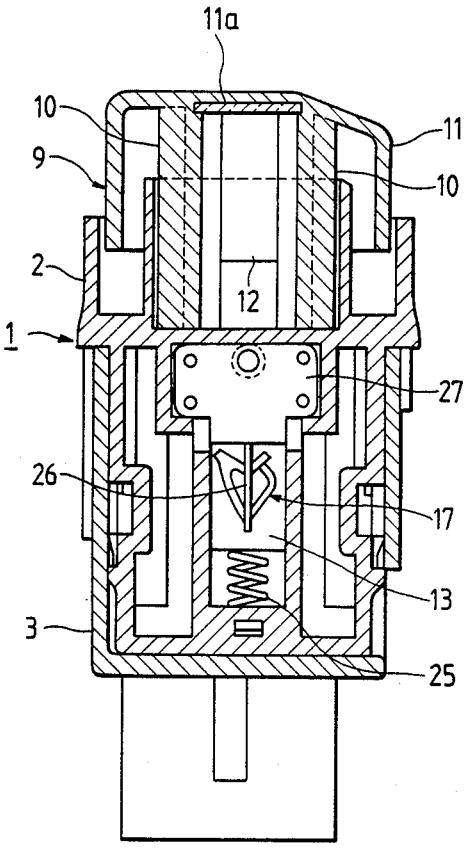
FIG. 3 is a cross-sectional view taken along the line III—III of FIG. 1.

The switch device shown in FIGS. 1 to 3 comprises a casing 1 made of a plastic material. The casing 1 includes a hollow elongated casing body 3 having a square cross-section and an hollow upper end member 2 fitted in the upper end portion of the casing body 3. A printed circuit board 4 is mounted within the casing 1 and has a plurality of conductors 5 on one of its sides (only one of the conductors is shown in the drawings). A lamp socket 7 is attached to the upper portion of the printed circuit board 4, and a display lamp 6 is mounted in the lamp socket 7. A plurality of lead wires (not shown) extending from the printed circuit board 4 are connected to external circuitry through a plurality of connector pins 8 passing through a bottom wall of the casing body 3 (only one of the pins 8 is shown in the drawings).

A plastic operating member 9 is mounted on the casing 1 and is disposed to move relative to the longitudinal axis of the casing 1. The operating member comprises a cap-shaped button portion 11 and a pair of operating legs 10 formed integrally with, and extending downward from, the push-button portion 11 into the casing body 3. The operating legs 10 have U-shaped notches **10*c*, each having upper and lower ends 10*a* and 10*b*. A display element 11*a* made of a transparent material having a mark indicative of the electrical devices that the switch controls is embedded in the upper end face of the push-button portion 11. A transparent plastic light-transmitting member 12 extends downward from the display element 11*a* and is disposed between the operating legs 10. The display lamp 6 is disposed below the light-transmitting member 12**.

A cam member 13 in the form of a block is secured to the lower ends of the operating legs 10. A contact plate 14 in the form of a leaf spring is mounted on a rear face of the cam member 13 in opposed relation to the printed circuit board 4. The contact plate 14 has a plurality of contacts 15 (only one of which is shown) engageable with the respective conductors 5. Thus, the contact plate 14 with the contacts 15 and the conductor 5 constitute a switch 16.

As depicted in FIGS. **5*a* and 5*b*, the cam member 13 has a cam groove 17 formed on its front face. The cam groove 17 is of a generally heart-like shape, and has a deep lower retaining portion 18, a right-hand side portion 19 extending upward from the lower retaining portion 18 to a deep upper portion 21. The right-hand side portion 19 progressively decreases in depth toward its upper end and includes a step down 20 into deep upper portion 21. The cam groove 17 also includes a left-hand side portion 24 extending downward from the upper portion 21 to the lower retaining portion 18 and progressively decreasing in depth toward its lower end. The upper portion 21 has a V-shaped upper retaining portion 22 at its center. The lower surface of the left-hand side portion 24 meets right-hand side portion 19 at the lower retaining portion 18 and includes a step down 23 into lower retaining portion 18. Thus, the cam groove 17** forms a closed loop.

A return spring 25 is disposed between the lower surface of the cam member 13 and the bottom wall of the casing body 1 to urge the cam member 13 and the operating member 9 in an upward direction.

The switch device also includes a metal lock pin 26 having bent end portions **26*a* and 26*b* so that the lock pin 26 assumes a generally U-shaped configuration. The upper end portion 26*a* is pivotally disposed in a hole 2*a* formed in the lower portion of the upper end member 2 of casing 1. The lock pin lower end portion 26*b* is disposed to ride in the cam groove 17 of cam member 13. The lock pin 26 is pivotally movable about the upper end portion 26*a* so that the lower end portion 26*b* can be moved along the cam groove 17 when the cam member 13 is moved relative to the casing 1**.

Figure 4:
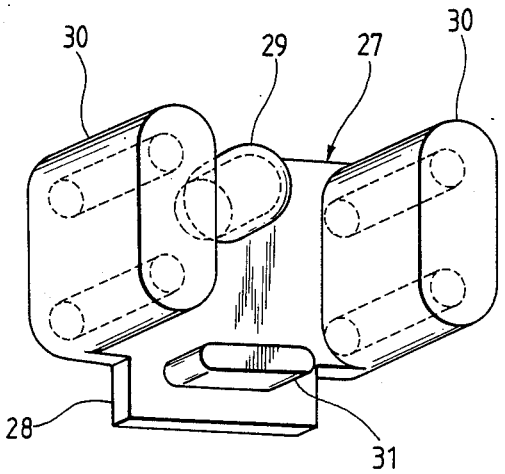
FIG. 4 is a perspective view of a cushioning member in accordance with the present invention.

A cushioning member 27 is mounted within the casing 1 a portion of which is disposed between the casing wall and lock pin **26*a*. The cushioning member 27 is made of a material having elasticity and a high coefficient of friction such as rubber. As shown in FIG. 4, the cushioning member 27 has a one-piece molded construction and includes a flat base portion 28 and a mounting portion 29 formed on one side of the base portion 28 at an upper central portion thereof for mounting the cushion member within the casing 1. A holder portion 31 is disposed below the mounting portion 29, and a pair of cushioning portions 30 are formed on either side of the holder portion 31. The cushioning portions 30 are received in the notches 10*c* of the two operating legs 10. The holder portion 31 frictionally engages the straight portion of the lock pin 26 between the opposite end portions 26*a* and 26*b* to urge the lock pin 26 toward the bottom of the cam groove 17**.

Figure 5A:
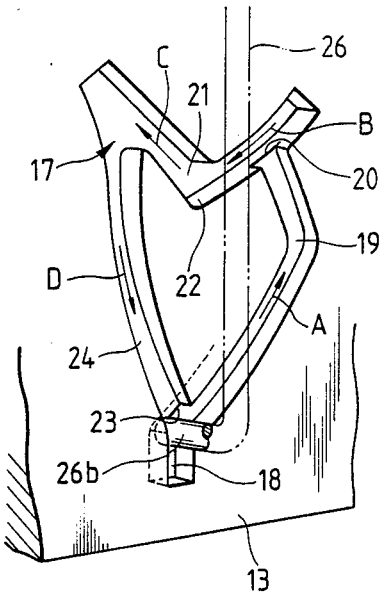
FIG. 5(*a*) is a perspective view of a portion of the cam member of FIG. 1.
Figure 5B:
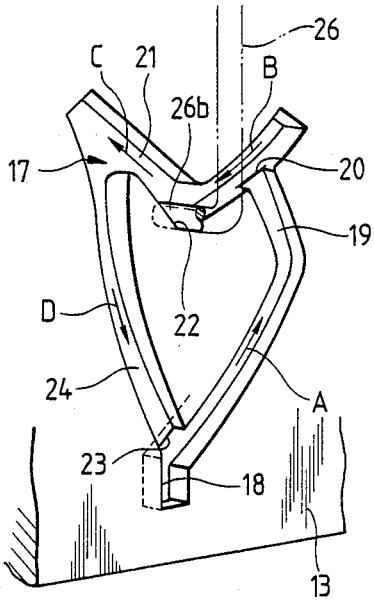
Figure 6:
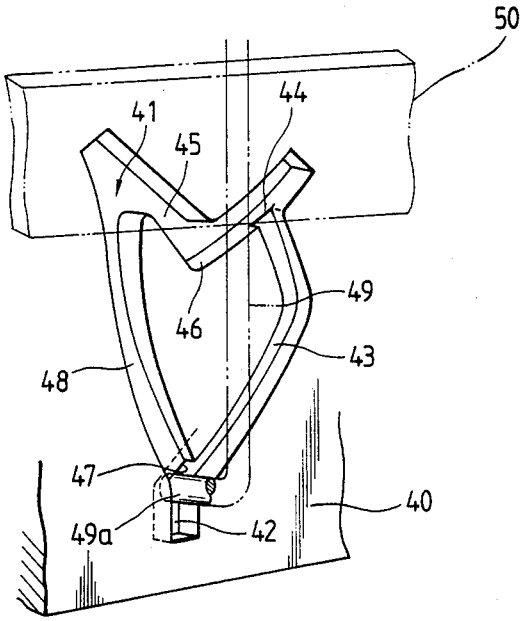
FIG. 6 PRIOR ART
FIG. 6 is a cam member and leaf spring of a conventional switch device.

The operation of the switch device of the invention will now be described. In the initial position as depicted in FIGS. 1 and 3, the operating member 9 is held in its protruding or inoperative position under the influence of the return spring 25, so that most of the push-button portion 11 projects upward from the casing 1. In this position, the lower abutment portions **10*b*of the operating legs 10 are held against the lower ends of the cushioning portions 30 of cushioning member 27. In addition, as shown in FIG. 5(*a*), the lower end portion 26*b*** of the lock pin 26 is retained in the lower retaining portion 18 of the cam groove 17 to hold the cam member 13 in its upper position. In the upper position, the contacts 15 of the contact plate 14 are disposed above the conductors 5 of the printed circuit board 4 to maintain the switch 16 in its open condition.

In order to turn on the switch, the push-button portion 11 is depressed, moving the operating member 9 in a downward direction against the bias of the return spring 25. The cam member 13 is fixed to the operating member 9 and therefore also moves in a downward direction with operating member 9. As a result, the lower end portion 26*b* of the lock pin 26 is disengaged from the lower retaining portion 18 of the cam groove 17 and is moved upward along the right-hand side portion 19 as indicated by arrow A in FIGS. 5(*a*) and 5(*b*). When the push-button portion 11 is further depressed so that the operating member 9 is at its lower most position, the upper abutment portions 10*a* of the operating legs 10 are held against the upper ends of the cushioning portions 30 of the cushioning member 27. In addition, the lower end portion 26*a* of the lock pin 26 moves from the right-side portion 19 of the cam groove 17 down step 20 then in a right-hand direction along the upper portion 21. When the push button portion 11 is released, the cam member 13 moves slightly upward under the influence of the return spring 25. This causes lock pin end portion 26*a* to move along cam groove upper portion 21 in a left-hand direction as indicated by an arrow B in FIG. 5(*b*). The operating member 9, is held in a substantially depressed position by the retention of the locking pin lower end portion 26*b* in the upper retaining portion 22 of the cam groove 17.

As shown in FIG. 2, in the depressed position, the contacts 15 of the contact plate 14 make electrical contact with the conductors 5 on the printed circuit board 4, to close the switch 16. At this time, the display lamp 6 disposed within the casing 1 is also lit, so that the display portion 11*a* is illuminated through the light-transmitting member 12.

In order to turn off the switch, the push-button portion 11 is again depressed to its lowermost position causing the cam member 13 to move in a downward direction. This causes the lock pin lower end portion 26*b* to be released from the upper retaining portion 22 of the cam groove 17. As a result, the lower end portion 26*b* is moved along the left-hand section of the upper portion 21 of the cam groove 17 as indicated by an arrow C in FIG. 5(*b*). Then, when the push-button portion 11 is released, return spring 25 causes the cam member 13, push-button 11, and operating member 9 to move in an upward direction to their initial or inoperative positions. As indicated by arrow D in FIG. 5(*a*), when the push-button portion 11 is released, the locking pin's lower end portion 26*a* moves in a downward direction along the left-hand side portion 24 over step 23 and is received in the lower retaining portion 18. As the cam 13 moves in an upward direction, the contacts 15 of the contact plate 14 are brought out of contact with the conductors 5 of the printed circuit board 4 to open the main switch and turn off the display lamp 6. As the cam member 13 and operating member 9 return to their upward positions, the lower abutment portions 10*b* of the operating legs 10 strike the lower ends of the cushioning portions 30. The cushioning portions 30 absorb shock to the internal components of the switch and hold the cam member 13 and the operating legs 9 in their initial or inoperative positions.

The hold portion 31 of the cushioning member 27 frictionally engages the lock pin 26 urging its lower end portion 26*b* into the cam groove 17. As described earlier, during operation of the switch, the lock pin 26 pivots back and forth in hole 2*a*. During this pivotal movement, portions of the lock pin strike various internal components resulting in impact sounds. The impact sounds resulting from this striking engagement are reduced by the cushioning member 27 because of its elastic nature. It is preferred that the cushioning member 27 is constructed of rubber with a high coefficient of friction. Since the holder portion 31 of the cushioning member 27 intersects the lock pin 27, considerable friction develops between the holder portion 31 and the lock pin 26. This prevents the lock pin 26 from undue pivotal movement even when the push-button portion 11 is abruptly depressed, and eliminates the possibility that the lower end portion 26*a* of the lock pin 26 will become disengaged from the cam groove 17.

While the switch device according to the present invention is specifically shown and described herein, the invention itself is not limited to the exact showing of the drawings and the description thereof. For example, the cam member 13 and the operating member 9 may be modified so that only the cam member is alternately held in its inoperative and operative positions each time the operating member is depressed, while the operating member always returns to its initial position.

What is claimed is:

1. A switch device having internal components, the switch device comprising:

a casing;

a depressible operating member at least partially mounted within said casing movable between a protruding position and a depressed position;

a cam member movable between an inoperative position and an operative position in response to the depression of said operating member, said cam member including a cam groove having a loop-like shape;

a return spring for urging said cam member toward said inoperative position;

an elongated engaging member having one end mounted on said casing and another end movably disposed in said cam groove, said another end being lockingly engageable in said cam groove to hold the cam member in said inoperative position and said operative position;

a cushioning member mounted within said casing, said cushioning member being made of a resilient material having elasticity and a high coefficient of friction, and being disposed to abuttingly engage said operating member when said operating member is returned from said depressed position to said protruding position for absorbing shock between said operating member and the internal components of the switch, said cushioning member having a holder portion for frictionally engaging said engaging member to urge said other end of said engaging member into said cam groove; and switch means mounted within said casing for being opened and closed in response to the movement of said cam member.

2. A switch device according to claim 1, wherein said cushioning member is made of molded rubber.

3. A switch device according to claim 1, wherein said cushioning member further includes a flat base portion on which said holder portion is formed, a mounting portion for mounting said cushioning member within said casing, and a cushioning portion for abuttingly engaging said operating member when said operating member is moved between said depressed position and said protruding position.

4. A switch device according to claim 3, wherein said operating member includes an operating portion integrally attached to and movable with said cam member, said operating member further including a notch in the direction of movement of said operating member, said notch having opposed edges spaced from each other in the direction of movement of said operating member, said cushioning portion of said cushion member being received in said notch, one of said opposed edges of said notch being brought into abutting engagement with said cushioning portion of said cushioning member when said operating member is moved to said depressed position, and the other edge of said notch being brought into abutting engagement with said cushioning portion when said operating member is returned to said protruding position.

5. A switch device according to claim 1, wherein said engaging member comprises a wire having bent end portions, said engaging member being pivotally mounted at one of said end portions on said casing and said other end portion being movably disposed to travel along said loop-like cam groove, said holder portion of said cushioning member frictionally engaging said engaging member in an area intermediate said end portions.

6. A switch device comprising:

a casing having an elongated axis;

a cam member disposed within said casing and including a groove;

an engaging member mounted within said casing and having an end portion movable along said groove;

a depressible operating member having a portion movably mounted within said casing between a protruding and a depressed position in a direction parallel to the elongated axis of said casing and for causing relative movement between said cam member and said engaging member corresponding to said protruding and depressed positions; and a cushioning member mounted within said casing and constructed of a resilient material having elasticity and a high coefficient of friction, said cushioning member including a holder portion for frictionally engaging said engaging member and biasing said engaging member against said groove, said cushioning member further having a cushioning portion for abutting said operating member for absorbing shock between said operating member and the internal components of the switch.

7. A switch device according to claim 6, wherein said cushion member is made of rubber.

8. A switch device according to claim 6, wherein said cushion member further includes at least one cushioning portion for cushioning the movement of said depressible operating member.

9. A switch device according to claim 6, wherein said groove has a loop-like shape.

* * * * *